US007775807B2

(12) United States Patent
Yamaguchi et al.

(10) Patent No.: US 7,775,807 B2
(45) Date of Patent: Aug. 17, 2010

(54) ELECTRICAL JUNCTION BOX

(75) Inventors: Jun Yamaguchi, Yokkaichi (JP); Kouichi Takagi, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 3 days.

(21) Appl. No.: 12/314,412

(22) Filed: Dec. 10, 2008

(65) Prior Publication Data

US 2009/0163053 A1 Jun. 25, 2009

(30) Foreign Application Priority Data

Dec. 25, 2007 (JP) ..... 2007-332341

(51) Int. Cl.
*H01R 12/00* (2006.01)

(52) U.S. Cl. ..... 439/76.2; 439/206; 439/949

(58) Field of Classification Search ..... 439/76.1, 439/76.2, 205, 206, 949
See application file for complete search history.

(56) References Cited

U.S. PATENT DOCUMENTS 6,796,809 B2 9/2004 Kakuta et al.
6,905,348 B2 * 6/2005 Naitou et al. ..... 439/76.2

FOREIGN PATENT DOCUMENTS

JP A-2003-348732 12/2003

* cited by examiner

*Primary Examiner*—Khiem Nguyen
(74) *Attorney, Agent, or Firm*—Oliff & Berridge, PLC

(57) ABSTRACT

An electrical junction box has a casing for housing a circuit board on which electrically conductive paths are formed. Fuse-receiving sections in an upper wall of the casing are adapted to receive a mating member. Receiving ribs inward from an inside of a side wall of the casing at a position below the fuse-receiving sections to receive water that enters the casing from the fuse-receiving sections, guide ribs project inward from an inside of the side wall provided with the receiving ribs and extend from end edges of the receiving ribs to guide the water that is received on the receiving ribs to a bottom wall of the casing. A bottom wall of the casing defines drain holes.

12 Claims, 14 Drawing Sheets

ELECTRICAL JUNCTION BOX

CROSS-REFERENCE TO RELATED APPLICATION

This application claims priority to JP 2007-332341 filed in Japan on Dec. 25, 2007, the entire disclosure of which is hereby incorporated by reference in its entirety.

BACKGROUND

The exemplary embodiments relate to an electrical junction box in which a circuit board is housed in a casing.

BACKGROUND ART

Heretofore, an electrical junction box has been known, as disclosed in JP 2003-348732A. The electrical junction box contains in a casing a circuit board on which electrically conductive paths are formed. An attaching section open in an upper wall of the casing so as to mount an external connector. Connecting terminals are contained in the attaching section so as to be connected to the external connector. The connecting terminals are disposed on a board connector attached to a circuit board.

The board connector is provided on an upper surface with a plurality of terminal supports for attaching the connecting terminals to the board connector. Grid-like spaces formed between the terminal supports, on opposite sides of the terminal supports, and between arrays of the terminal supports define drain holes. Since water that enters the casing from the attaching section can be drained through the drain holes, a short circuit between circuits is prevented.

SUMMARY

However, according to the above construction, it is necessary to provide on the board connector the terminal supports for attaching the connecting terminals to the board connector and the drain holes for draining the water that falls down onto an upper surface of the board connector. Thus, the board connector has a complicated shape and expensive manufacturing costs.

In view of the above problems, an object of the present invention is to provide an electrical junction box in which a drainage structure is simplified.

An electrical junction box in accordance with the exemplary embodiments include a casing having a sidewall, a bottom wall defining drain holes, and an upper wall defining openings, the casing housing a circuit board on which electrically conductive paths are formed, and the openings being adapted to contain a mating member. The casing also includes receiving ribs and guide ribs. The receiving ribs project inward from an inside of a side wall of the casing at a position below the openings to receive water that enters the casing from the openings. The guide ribs project inward from the inside of the side wall provided with the receiving ribs and extend from end edges of the receiving ribs to guide the water that is received on the receiving ribs to the bottom wall of the casing.

According to the exemplary embodiments, the water that enters the casing from the openings is received by the receiving ribs below the openings. The water that drops down onto the receiving ribs is guided by the guide ribs to flow down to the bottom wall of the casing. The water reaches the bottom wall and is drained out through the drain holes to the outside.

Thus, it is possible to surely restrain the water that enters the casing from adhering to the circuit board and from causing a short circuit in the electrically conductive paths.

The receiving ribs and guide ribs project inward from the inside of the side wall of the casing. Generally, the side wall of the casing is provided on an inside with ribs for reinforcing the casing. According to the exemplary embodiments, it is possible to utilize the reinforcing ribs as a drainage structure for water that enters the casing. Thus, because any additional drainage structure is not required for the casing, it is possible to simplify the structure of the electrical junction box.

The following embodiments of the electrical junction box in accordance with the present invention will be preferable.

The circuit board may be housed in the casing so that the circuit board is disposed vertically, and the receiving ribs and guiding ribs may be provided on a facing side wall of the casing opposed to at least one of surfaces of the circuit board.

According to the above construction, it is possible to restrain the water, which enters the casing from the openings, from dropping down onto the surface of the circuit board by means of the receiving ribs provided on the facing side walls opposed to the surface of the circuit board. Thus, it is possible to prevent the electrically conductive paths provided on the circuit board from causing a short circuit.

One of surfaces of the circuit board may define a mounting surface on which electronic components are mounted, and the facing side wall may be opposed to the mounting surface.

According to the above construction, it is possible to restrain the water from adhering to the electronic components mounted on the circuit board. Thus, it is possible to prevent a short circuit between the electronic components and the electrically conductive paths on the circuit board.

An other surface of the circuit board may define a non-mounting surface, and a seal member may be filled in a space between the non-mounting surface and a side wall of the casing opposed to the non-mounting surface.

According to the above construction, it is possible to enhance a waterproof function of the non-mounting surface on the circuit board.

The mounting surface of the circuit board may be covered with the seal member.

According to the above construction, it is possible to further enhance a waterproof function of the connected portions between the electrically conductive paths on the circuit board and the electronic components.

The end edges of the receiving ribs at a side of the circuit board may be embedded in the seal member.

According to the above construction, it is possible to more securely restrain the water from flowing downward to the lower part of the receiving ribs.

One of the receiving ribs maybe provided on an upper surface with first slopes that are inclined toward end edges provided with the guide ribs.

According to the above construction, the water drops down onto the receiving ribs and flows down readily to the guide ribs along the first slopes. This can enhance a drainage function.

One of the receiving ribs may be provided on an upper surface with a second slope that is inclined from an end edge at a side of the circuit board to the facing side wall.

According to the above construction, the water drops down onto the receiving ribs and flows to the facing side wall along the second slope. Thus, it is possible to restrain the water from flowing from the receiving ribs to the side of the board circuit.

One of the receiving ribs may be provided on a side of the circuit board with a cutoff wall projecting upward.

According to the above construction, it is possible to restrain the water, which drops down onto the receiving rib, from flowing down from the end edges at the side of the circuit board onto the circuit board.

According to the exemplary embodiments, it is possible for a simple structure to drain water entering an electrical junction box.

DETAILED DESCRIPTION OF EMBODIMENTS

Referring now to FIGS. 1 to 9, a first embodiment, in which the present invention is applied to an electrical junction box 10 to be mounted in a motor vehicle, will be described below. The electrical junction box 10 is connected between a power source (not shown) such as a battery and on-vehicle electrical components (not shown) such as head lamps and wipers to switch on and off the on-vehicle electrical components.

Figure 1:
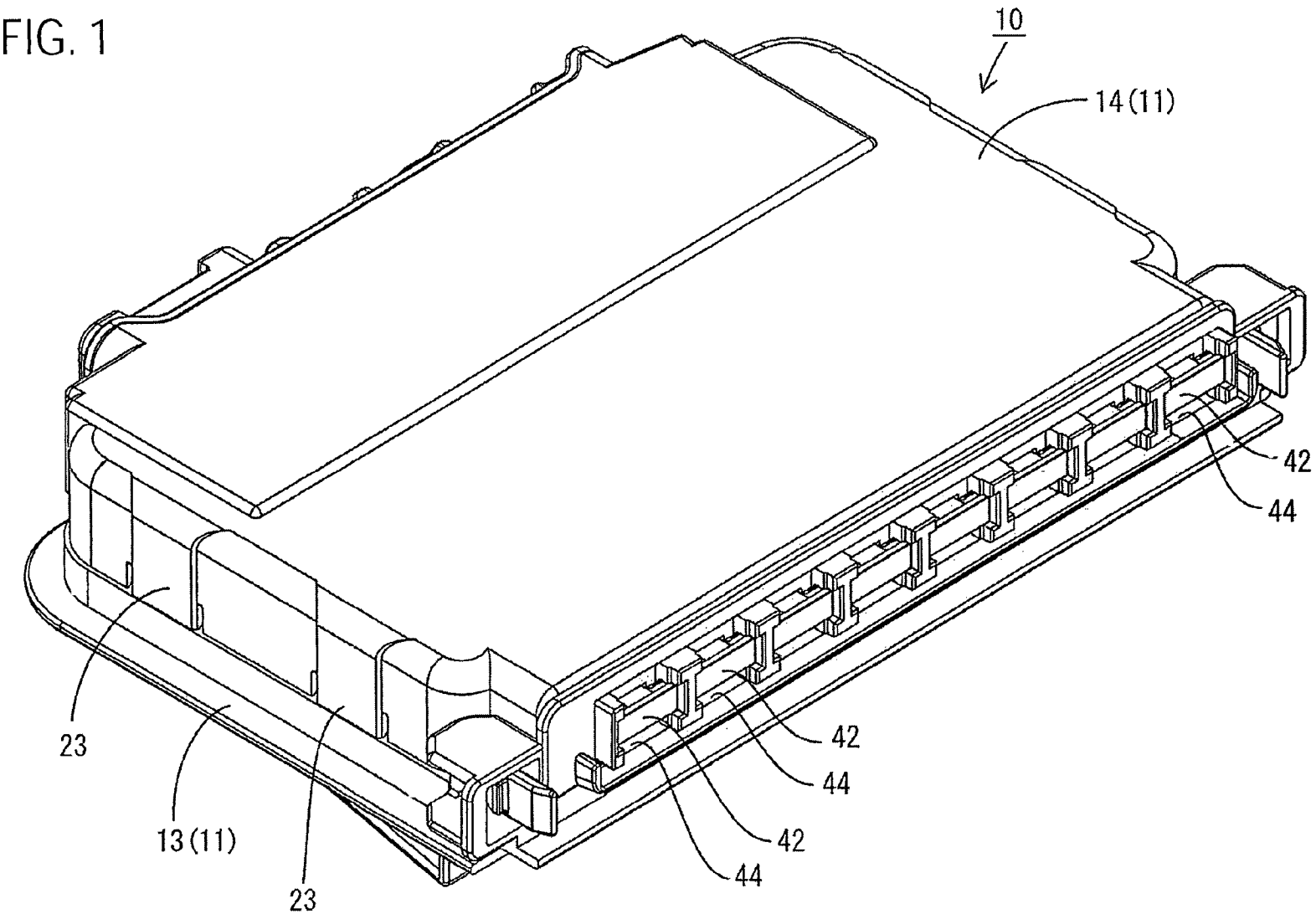
FIG. 1 is a perspective view of a first embodiment of an electrical junction box in accordance with the exemplary embodiments.
Figure 2:
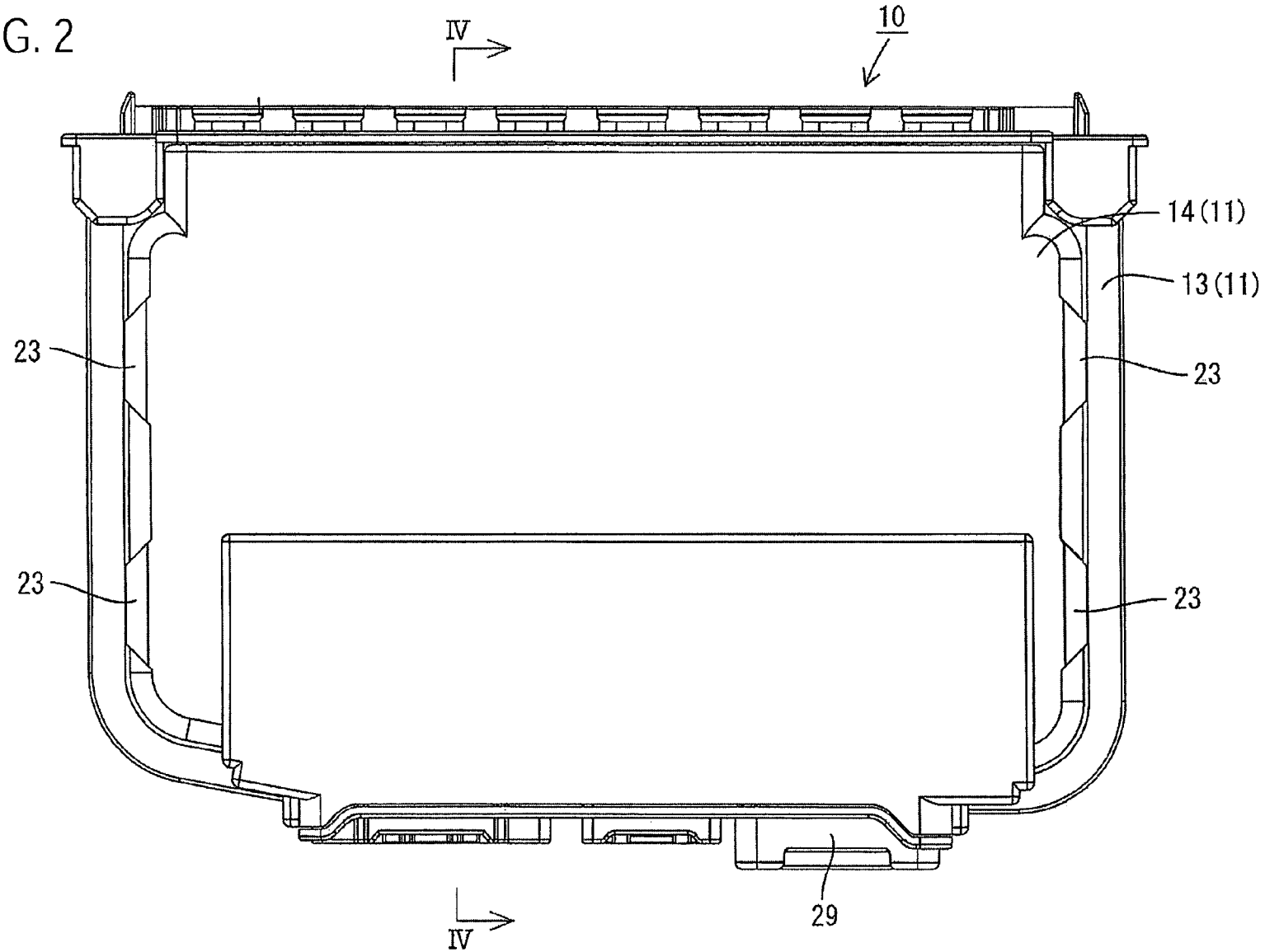
FIG. 2 is a front elevation view of the electrical junction box shown in FIG. 1.

In the description hereinafter, an upper side in FIG. 2 defines "an upper part or direction", a lower side in FIG. 2 defines "a lower part or direction". A right side in FIG. 2 defines "a right part or direction" and a left side in FIG. 2 defines "a left part or direction". A fore side in a direction penetrating a paper in FIG. 2 defines "a front side" and an inner side in the direction penetrating the paper in FIG. 2 defines "a rear side".

Figure 4:
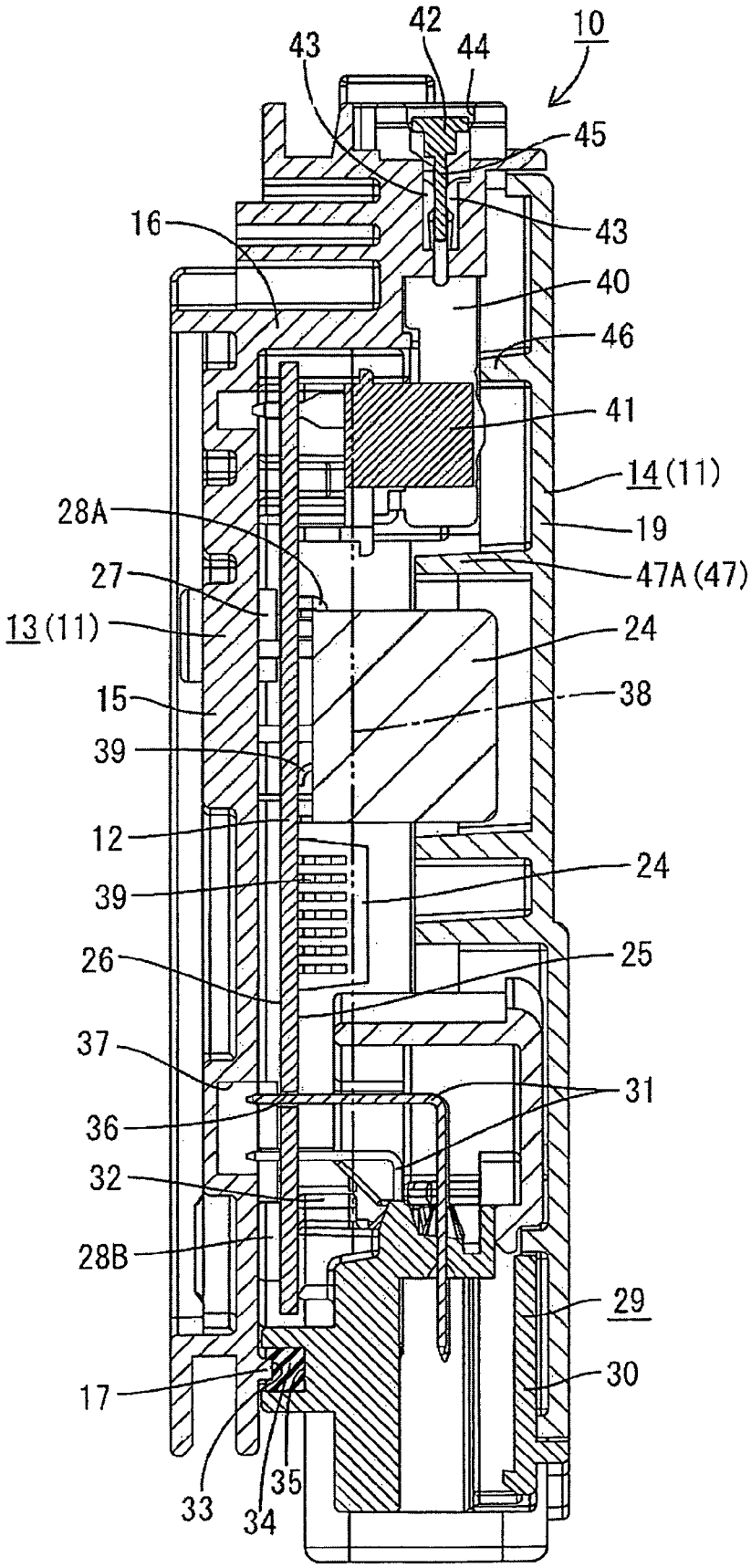
FIG. 4 is a cross section view of the electrical junction box taken along lines IV-IV in FIG. 2.

As shown in FIG. 4, the electrical junction box 10 contains a circuit board 12 in a flat casing 11. The casing 11 includes a casing body 13 made of a synthetic resin material and having an opening at a front side (a right side in FIG. 4) and a cover 14 made of a synthetic resin material and closing the opening in the casing body 13. As shown in FIG. 4, the electrical junction box 10 in the first embodiment is mounted in an engine compartment in a motor vehicle (not shown) so that the circuit board 12 stands up in a vertical direction.

Figure 3:
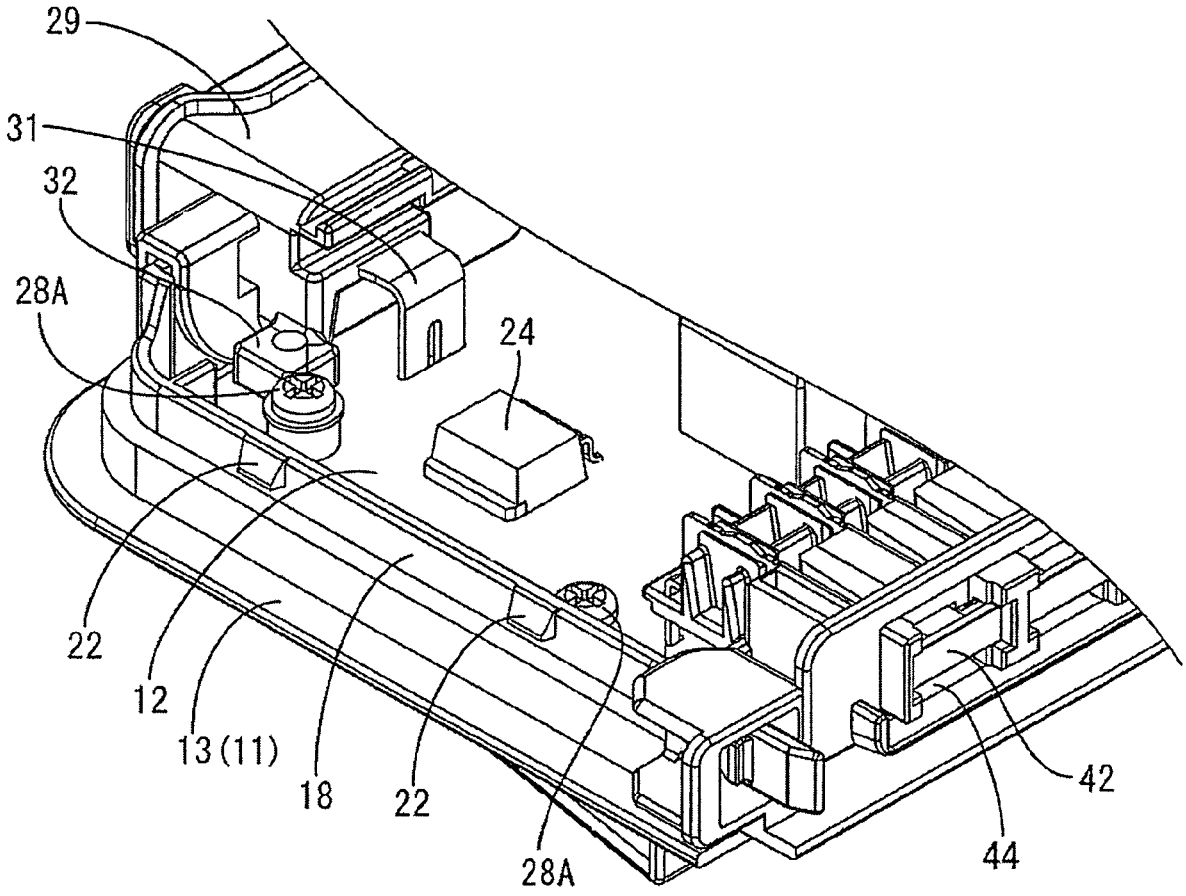
FIG. 3 is a partially broken perspective view of a part of the electrical junction box in FIG. 1, illustrating the box from which a cover is removed.

As shown in FIG. 4, the casing body 13 may be formed into a shallow container. The casing body 13 may include a rear wall 15 at a rear side (a left side in FIG. 4), an upper wall 16 at an upper side, and a body bottom wall (corresponding to a bottom wall) 17 at a lower side. As shown in FIG. 3, the casing body 13 may be provided on right and left sides of the rear wall 15 with a pair of body side walls 18 projecting from the rear wall 15 toward a front side (an upper side in FIG. 3).

Figure 6:
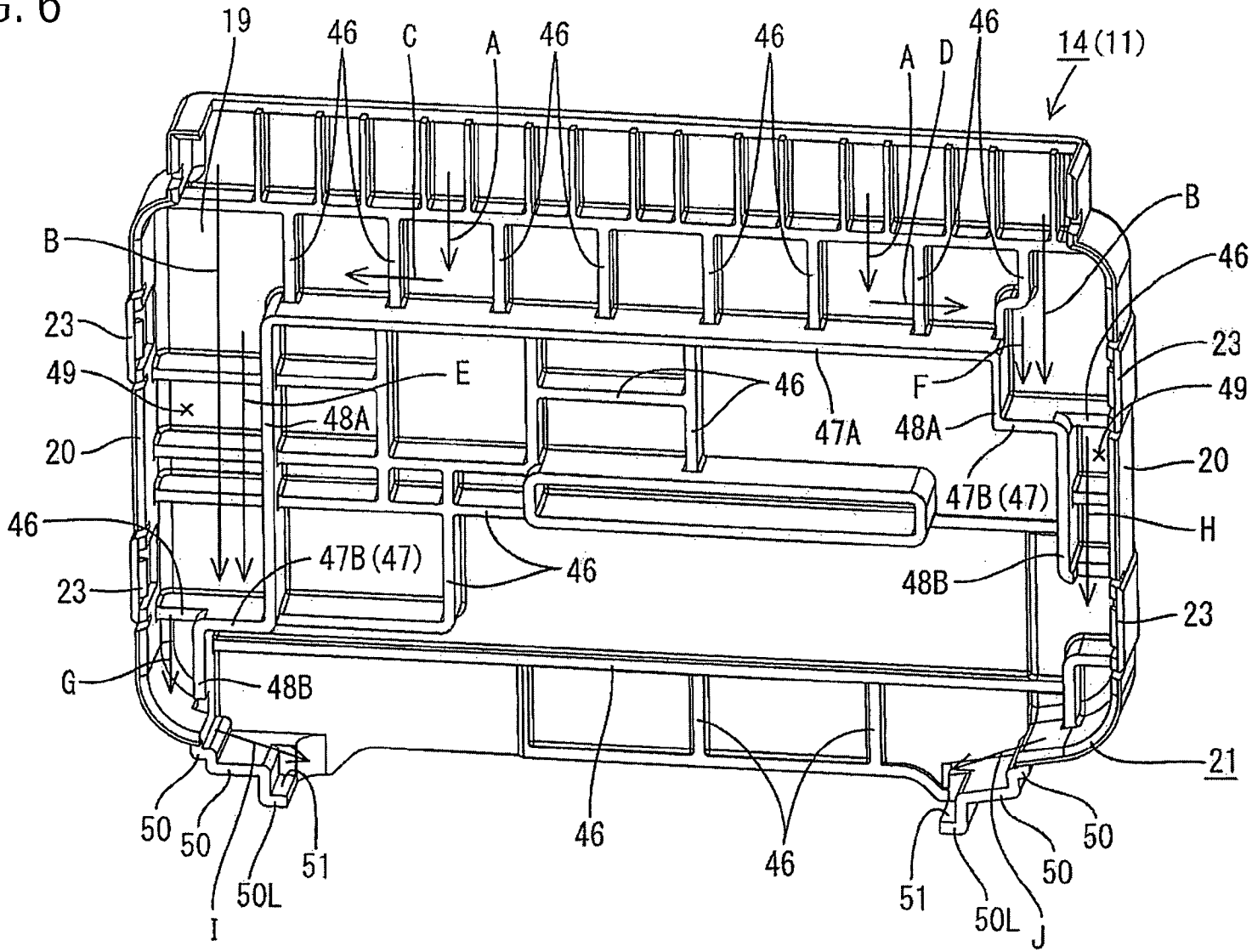
FIG. 6 is a perspective view of the cover shown in FIG. 5.
Figure 7:
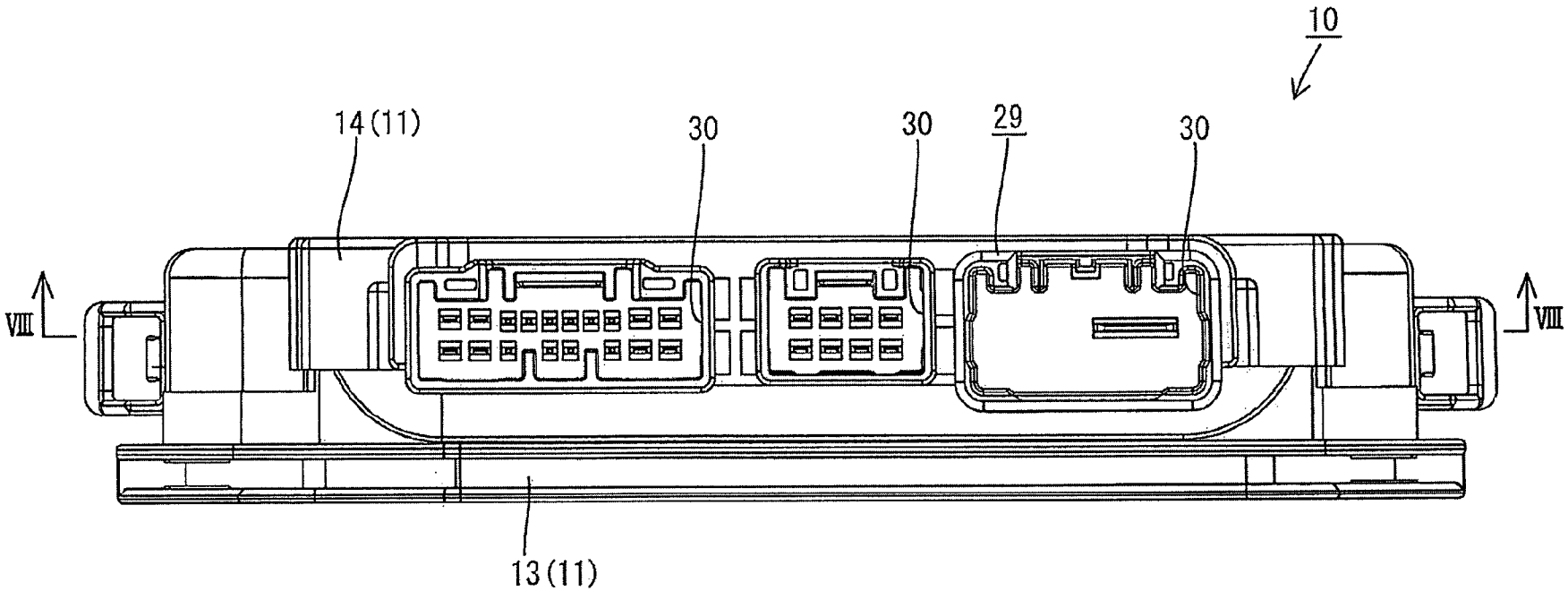
FIG. 7 is a bottom view of the electrical junction box shown in FIG. 2.

As shown in FIG. 4, the cover 14 may be formed into a shallow container. The cover 14 may include a front wall (corresponding to a side wall or an opposed wall) 19 at a front side (a right side in FIG. 4). As shown in FIG. 6, the cover 14 may include a pair of cover side walls 20 that project from right and left sides of the front wall 19 to a rear side (a fore side in a direction penetrating a paper in FIG. 6) and a cover bottom wall (corresponding to bottom wall) 21 at a lower side. The cover 14 may be attached to the casing body 13, when a plurality of lock portions 22 (FIG. 3) provided on an outer side surface of the body side wall 18 of the casing body 13 are elastically engaged with a plurality of lock-receiving portions 23 (FIGS. 1 and 6) of the cover side wall 20 provided on positions corresponding to the lock portions 22.

(Circuit Board 12)

The circuit board 12 may be provided on a surface with electrically conductive paths (not shown), which may be formed by means of a printed wiring technique. As shown in FIG. 4, electronic components 24 may be mounted on the electrically conductive paths on a front surface (a right side surface in FIG. 4) of the circuit board 12. Lead terminal 39 of the electronic components 24 may be electrically connected to the electrically conductive paths on the circuit board 12. The front surface of the circuit board 12 defines a mounting surface 25. The electronic components 24 are not mounted on a rear surface of the circuit board 12. The rear surface of the circuit board 12 defines a non-mounting surface 26. A thick film board may be formed by laminating a plurality of insulation boards on which the electrically conductive paths are formed.

The casing body 13 may be provided on the rear wall 15 with support bosses 27 that project toward a front side (a right side in FIG. 4) to support the circuit board 12 from a rear side (a left side in FIG. 4). The circuit board 12 may be mounted on the front surfaces (right surfaces in FIG. 4) of the support bosses 22 and may be spaced away from the rear wall 15 of the casing body 13 to be overlaid on the rear wall 15. The circuit board 12 and casing body 13 may be secured to the support bosses 27 by screwing bolts 28A through the circuit board 12 to the support bosses 27.

An elongated connector housing (corresponding to a bottom wall) 29 made of a synthetic resin material may be disposed at a relatively lower end with respect to the circuit board 12 in FIG. 4. In the first embodiment, the connector housing 29 serves as a board connector to be connected to the circuit board 12. The connector housing 29 may include a hood section 30 adapted to be coupled to a mating connector (not shown) and having an opening directed downward in FIG. 4. Connector terminals 31 may be disposed in an inner wall of the hood section 30. The connector terminals 31 may pass through the hood section 30 in a vertical direction, as shown in FIG. 4, to project into the hood section 30.

As shown in FIG. 4, the connector housing 29 is provided with a bolt-receiving portion 32 in which a bolt 28B or other connecting device, passing through the circuit board 12 from its rear side (a left side in FIG. 4) may be screwed or attached. When the bolt 28B, for example, is screwed in the bolt-receiving portion 28, the connector housing 29 is secured to the circuit board 12.

A body bottom wall 17 of the casing body 13 may be depressed toward the rear wall 15 to define a receiving recess 33 for containing the connector housing 29. The connector housing 29 may be contained in the receiving recess 33. The connector housing 29 may be provided in a position opposed to the receiving recess 33 with a groove 35 for containing a packing 34. When the packing 34 is contained in the groove 35 and is brought into close contact with a clearance between an inner surface of the groove 35 and the receiving recess 33, a clearance between the casing body 13 and the connector housing 29 is sealed.

As shown in FIG. 4, an end of each connector terminal 31 may project upward from the connector housing 29 in FIG. 4. The end may be bent toward the circuit board 12 by about a right angle and inserted into each through-hole 36 in the circuit board 12 to be electrically connected to the electrically conductive paths on the circuit board 12 by, for example, soldering. The connector terminals 31 may be juxtaposed on two layers in front and rear directions (right and left directions in FIG. 4) and juxtaposed on a plurality of arrays in the right and left directions (the direction penetrating the paper in FIG. 4).

The connector terminals 31 may pass the through-holes 36 to project from the non-mounting surface 26. The rear wall 15 of the casing body 13 may be disposed at positions corresponding to the connector terminals 31 with a clearance recess 37 depressed toward the rear side (the left side in FIG. 4) to escape from ends of the connector terminals 31.

As shown by a two-dot chain line in FIG. 4, a seal member 38 made of a synthetic resin material may fill in a space enclosed by the connector housing 29 and the rear wall 15, body side wall 18, upper wall 16, and body bottom wall of the casing body 13. The seal member 38 may fill the clearance recess 37 in the casing body 13 and a space between the circuit board 12 and the rear wall 15 of the casing body 13. The front surface (mounting surface 25) of the circuit board 12 may be covered with the seal member 38. The seal member 38 may be filled to a level in height enough to cover lead terminals 39 of the electronic components 24.

Figure 8:
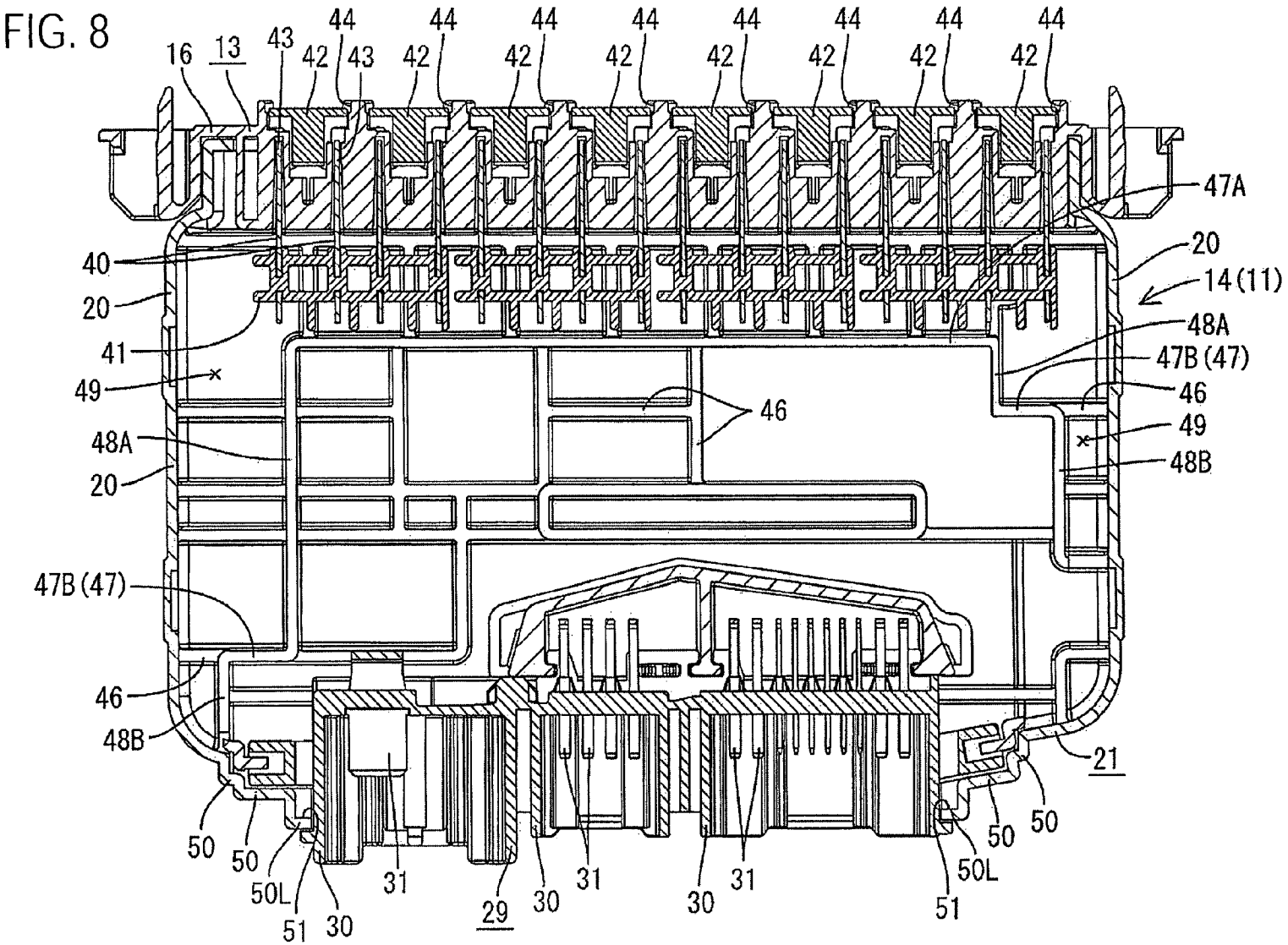
FIG. 8 is a longitudinal section view of the electrical junction box taken along lines VIII-VIII in FIG. 7.

A plurality of fuse side terminal metals 40 may be disposed at a relatively upper end in FIG. 4 on the circuit board 12. As shown in FIG. 8, the fuse side terminal metals 40 are juxtaposed in the right and left directions. A set of several fuse side terminal metals 40 are arrayed on and held in each of holders 41 made of a synthetic resin material.

Each of the fuse side terminal metals 40 may be formed into a substantially L-shaped configuration. One end of each fuse side terminal metal 40 maybe supported in each holder 41 so that the end is directed to the rear side. The end of each fuse side terminal metal 40 may be inserted into and soldered to a through-hole (not shown) provided in the circuit board 12 to be electrically connected to the electrically conductive paths on the circuit board 12. The end of the fuse side terminal metal 40 may be inserted into the through-hole and may project from the non-mounting surface 26.

The other end of each fuse side terminal metal 40 may be supported in each holder 41 so that the other end is directed upward. The other end of the fuse side terminal metal may define a terminal portion 43 to be connected to each fuse (corresponding to a mating member) 42.

As shown in FIGS. 4 and 8, the terminal portions 43 may be contained in a plurality of fuse-receiving sections (corresponding to openings) 44 that are open in a vertical direction in the upper wall 16 of the casing body 13. The fuse-receiving sections 42 detachably contain the fuses 42. When the fuses 42 are inserted into the fuse-receiving sections 44, fuse terminals 45 of the fuses 40 are electrically connected to the terminal portions 43 of the fuse side terminal metals 40.

Figure 5:
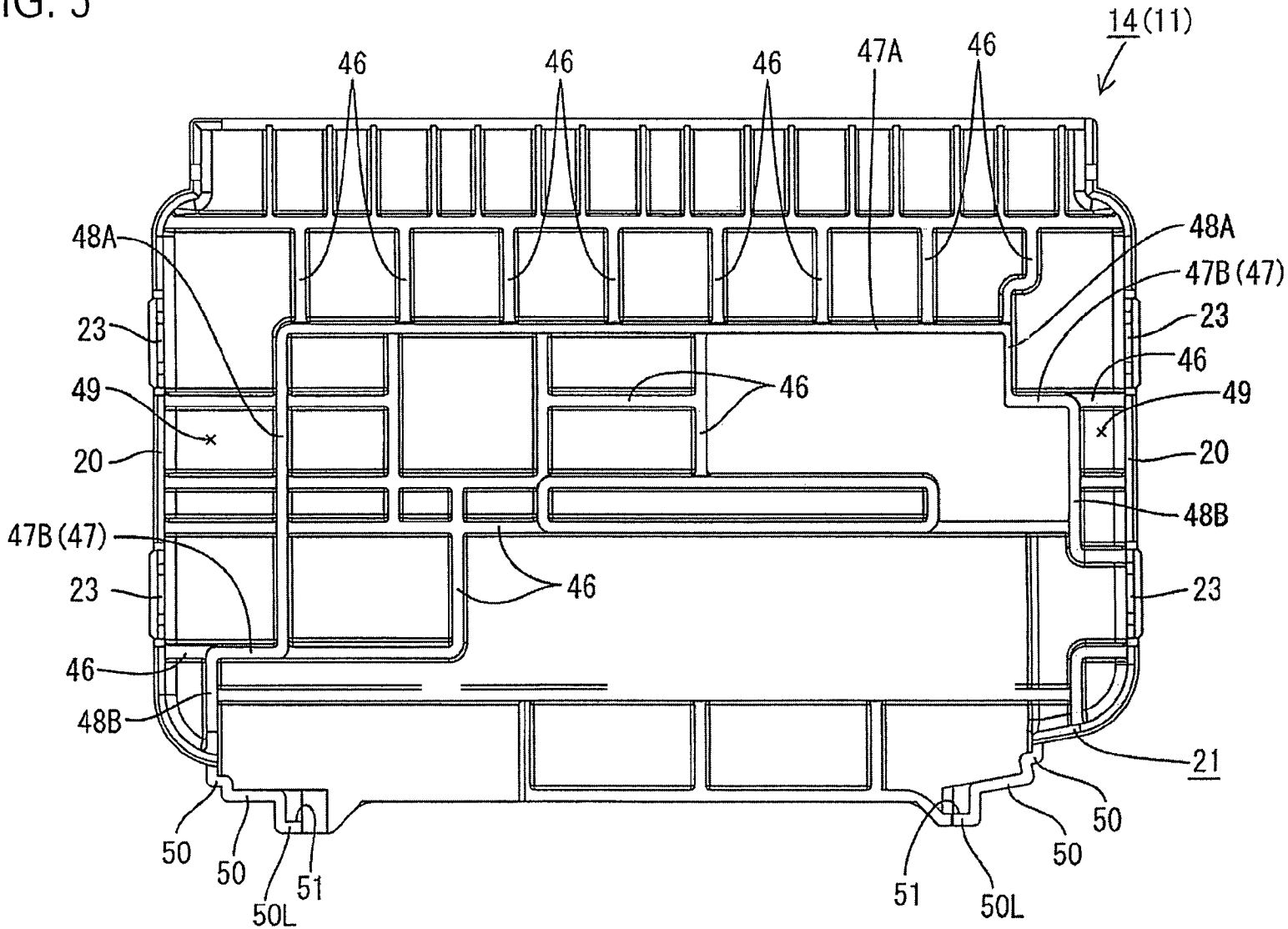
FIG. 5 is a back side view of a cover, illustrating a rear side of the cover.

As shown in FIGS. 4 and 6, the front wall 19 of the cover 14 may be provided on an inner side with a plurality of ribs 46 projecting toward an inside of the casing 11. As shown in FIG. 5, these ribs 46 include a first set of ribs 46 extending in a vertical direction and a second set of ribs 46 extending in a horizontal direction. The first and second sets of ribs 46 intersect one another at a substantially right angle. This can enhance the strength of the cover.

As shown in FIGS. 4 and 8, receiving ribs 47 may be provided below the fuse-receiving sections 44 and the fuse side terminal metals 40. Each receiving rib 47 projects inward from an inside of the front wall 19 and extends in a lateral direction (right and left directions in FIG. 8) so as to receive the water, for example, or other fluid, or debris, or the like, that enters the casing 11 through the fuse-receiving sections 44. As shown in FIGS. 4 and 8, in the first embodiment, a projection height of each receiving rib 47 from the front wall 19 may be set to be greater than that of each of the other ribs 46 from the front wall 19 so that the receiving rib 47 can receive the water, which falls down from the fuse-receiving sections 44, on at least a position directly below the fuse-receiving sections 44.

The receiving ribs 47 may include a first receiving rib 47A at an upper side of the cover 14 in FIG. 6, and second receiving ribs 47B at a lower side of the cover 14 and at outsides from the first receiving rib 47A in the lateral direction (right and left directions in FIG. 6). The front wall 19 may be provided on an inside with two first guide ribs 48A that project inward and extend downward from lateral opposite outer side end edges of the first receiving rib 47A. Lower ends of the first guide ribs 48A are continued to respective lateral inner side end edges of the second receiving ribs 47B.

Furthermore, the front wall 19 may be provided on an inside with two second guide ribs 48B that project inward and extend downward from lateral opposite outer side end edges of the second receiving ribs 47B. Lower ends of the second guide ribs 48B are spaced away from the bottom wall 21 of the cover 14.

The second receiving ribs 47B may be provided on lateral opposite end edges with the ribs 46 that extend outward laterally and project inward from the inside of the front wall 19.

A space enclosed by the first, guide ribs 48A, second guide ribs 48B, front wall 19, and cover side wall 20 may define a drainage passage 49 for inducing into the cover bottom wall 21 the water that enters the casing 11 from the fuse-receiving sections 44 provided on the upper wall 16 of the casing 11.

Figure 9:
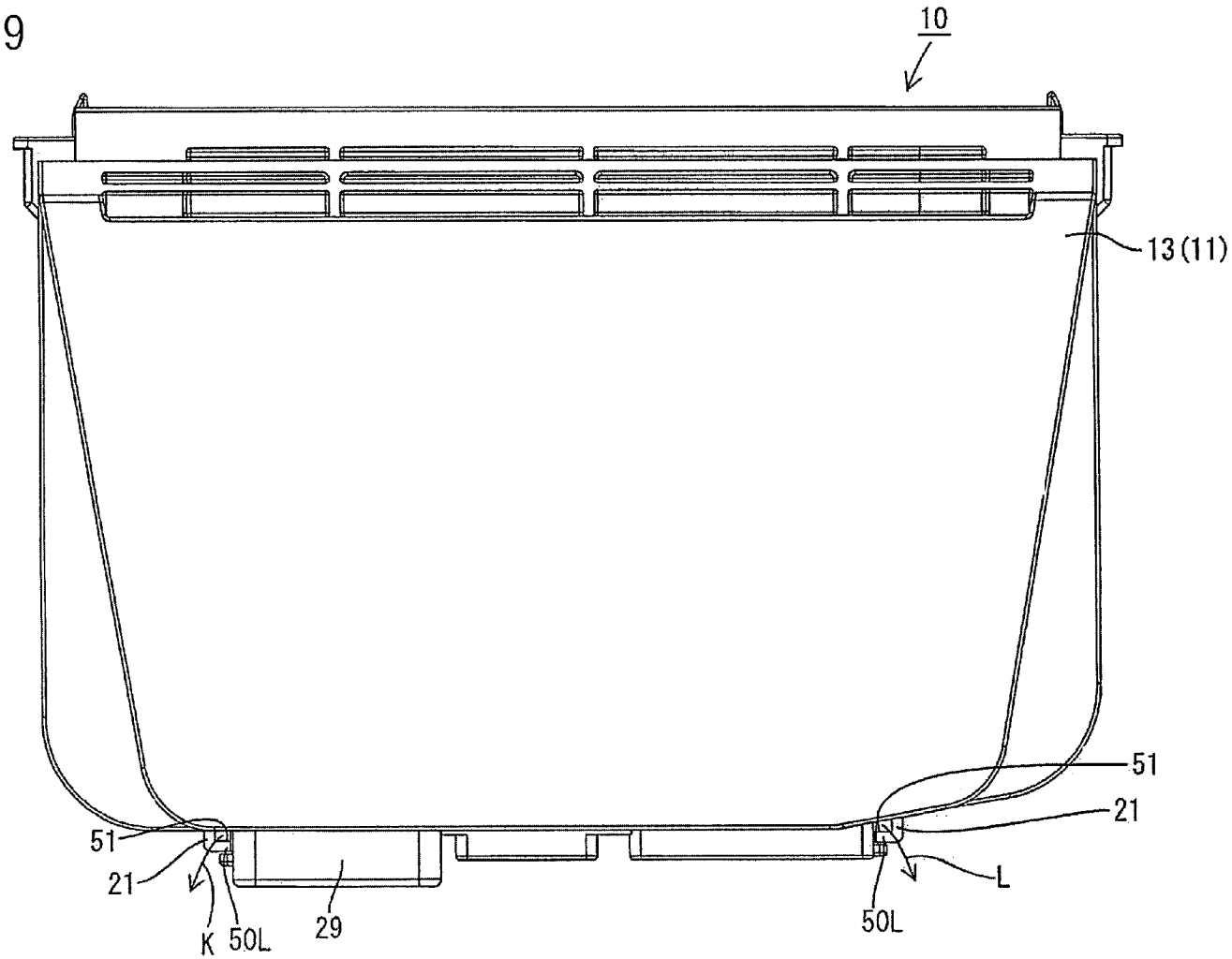
FIG. 9 is a back side view of the electrical junction box shown in FIG. 2.

As shown in FIG. 5, the cover bottom wall 21 may be provided with a plurality of stepped portions 50 that are depressed downward from an outside to an inside in a lateral direction (right and left directions in FIG. 5). As shown in FIG. 8, clearances are defined between the lowermost stepped portions 50L of the cover bottom wall 21 and an outer wall of the connector housing 29. The clearances define drain holes 51 adapted to drain out the water that enters the casing 11. The interior of the casing 11 may communicate with the outside through the drain holes 51. As shown in FIG. 9, the drain holes 51 are open at the rear side of the electrical junction box 10.

Next, an operation and effects of the first embodiment will be described below. As described above, the electrical junction box 10 in the first embodiment is contained in an engine compartment of a motor vehicle. Consequently, there is a possibility that water may enter the casing 11 through the fuse-receiving sections 44 upon vehicle-washing, rainfalls, or the like. In this case, the water entering the fuse-receiving sections 44 may adhere to the fuse side terminal metals 40. The water adheres to the fuse side terminal metals 40 and flows downward along the metals 40. The water reaches lower ends of the fuse side terminal metals 40 and drops down from there (see arrows A and B in FIG. 6). The water drops down from the fuse side terminal metals 40 and is received by the first and second receiving ribs 47A and 47B below the fuse-receiving sections 44.

The water that drops down onto the first receiving rib 47A flows outward laterally on an upper surface of the first receiving rib 47A (see arrows C and D in FIG. 6). The water reaches lateral opposite end edges of the first receiving rib 47A and is guided by the first guide ribs 48A continued to the lateral outer end edges of the first receiving rib 47A to flow downward in the drainage passages 49 (see arrows E and F in FIG. 6). The lower ends of the first guide ribs 48A are continued to the second receiving ribs 47B. The water flows downward in the drainage passages 49 and further flows downward onto the second receiving ribs 47B.

The water that drops down onto the second receiving ribs 47B may be guided by the second guide ribs 48B continued to the lateral outer end edges of the second receiving ribs 47B to flow downward on the cover bottom wall 21 (see arrows G and H in FIG. 6). The water may reach the cover bottom wall 21 and may flow downward along an upper surface of the cover bottom wall 21 (see arrows I and J in FIG. 6). A small clearance may be defined among the upper surface of the cover bottom wall 21, the body bottom wall 17, and the connector housing 29. The water drops down through the clearance in sequence onto the plural stepped portions 50 provided on the cover bottom wall 21 so that the water will reach the drain holes 51 from the lowermost stepped portions 50L. The water reaches the drain hole 51 and is drained out from the casing 11 (see arrows K and L in FIG. 9). Thus, it is possible to restrain the electrically conductive paths on the circuit board 12 from causing a short circuit by the water that enters the casing 11 and adheres to the circuit board 12.

The first receiving rib 47A, second receiving ribs 47B, first guide ribs 48A, and second guide ribs 48B may project inward from the inside of the front wall 19 of the cover 14. Although the ribs 46 may initially be provided on the cover 14 in order to increase strength of the cover 14, according to the first embodiment, the projection height of each rib 46 from the front wall 19 may be set to be greater than that of each of the other ribs 46, and a structure of the casing can be simplified. Therefore, this simplified structure can be utilized as a drainage structure for the water entering the casing 11. Thus, because any additional drainage structure is not required, it is possible to simplify the drainage structure of the electrical junction box.

According to the first embodiment, the circuit board 12 is contained in the casing 11 so that the circuit board 12 stands up vertically, the first receiving rib 47A, second receiving ribs 47B, first guide ribs 48A, and second guide ribs 48B project inward from the inside of the front wall 19 opposed to the surface of the circuit board 12. Thus, the water that enters the fuse-receiving sections 44 can be restrained from dropping down onto the circuit board 12. Consequently, it is possible to prevent the electrically conductive paths on the circuit board 12 from causing a short circuit.

Furthermore, according to the first embodiment, one of the surfaces of the circuit board 12 may define the mounting surface 25 on which the electronic components 24 are mounted and the front wall 19 of the cover 14 is opposed to the mounting surface 25. Thus, because it is possible to restrain the water from adhering to the electronic components 24 mounted on the circuit board 12, the short circuit can be prevented between the electronic components 24 and the electrically conductive paths on the circuit board 12.

In addition, according to the first embodiment, the other surface of the circuit board 12 may define the non-mounting surface 26 and the seal member 38 may be filled in the space between the non-mounting surface 26 and the rear wall 15 opposed to the non-mounting surface 26. Thus, it is possible to prevent the short circuit between the ends of fuse side terminal metals 40 and the connector terminals 31 that project toward the non-mounting surface 26 of the circuit board 12. As a result, it is possible to enhance a waterproof function at the side of the non-mounting surface 26 of the circuit board 12.

In addition, according to the first embodiment, the mounting surface 25 of the circuit board 12 may be covered with the seal member 38. Thus, it is possible to further enhance a waterproof function of the connected portions between the electrically conductive paths on the circuit board 12 and the lead terminals 39 of the electronic components 24.

Figure 10:
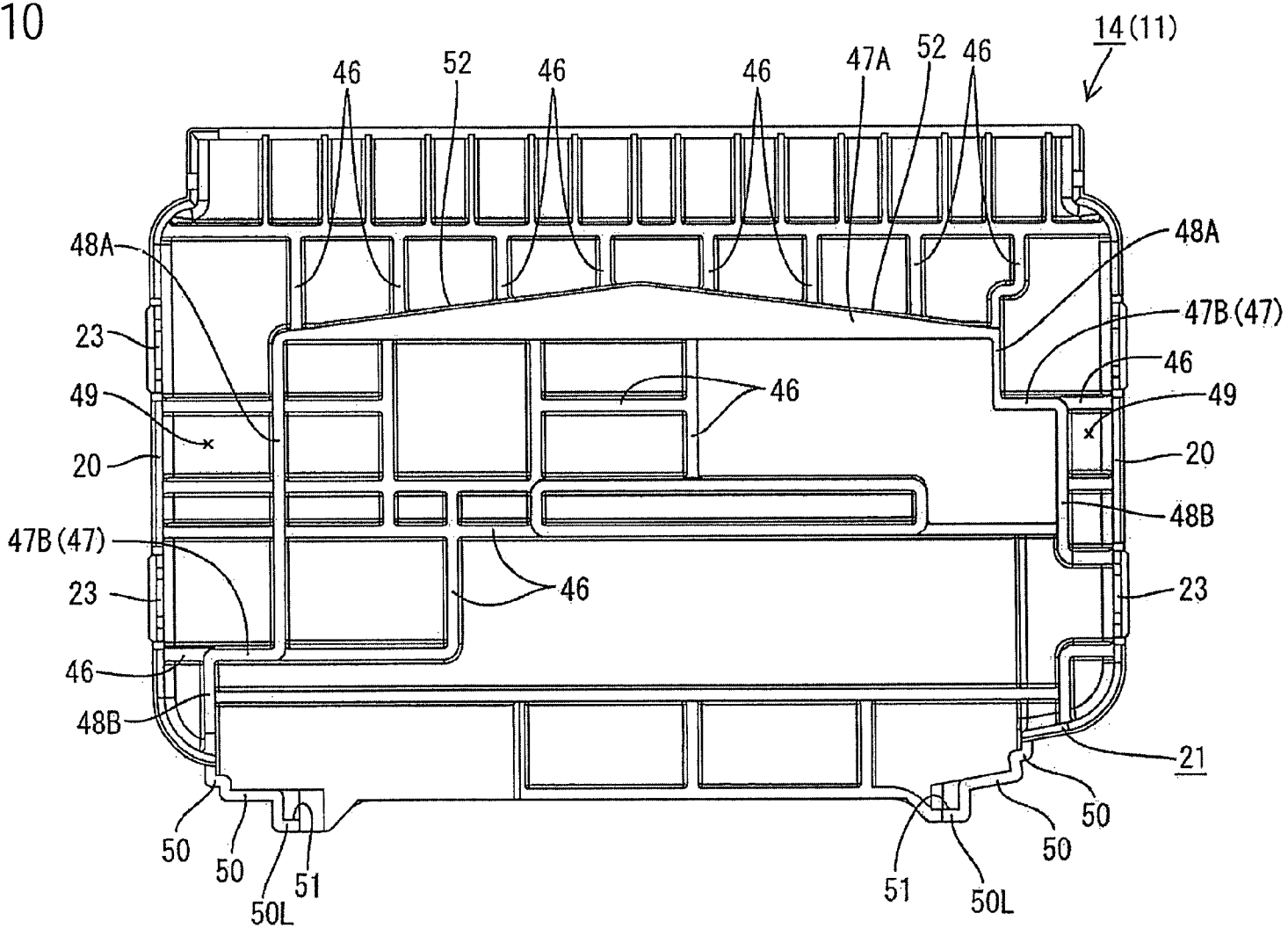
FIG. 10 is a back side view of a cover in a second embodiment of the electrical junction box, illustrating a rear side of the cover.

Next, a second embodiment of the electrical junction box 10 in accordance with the exemplary embodiments will be described by referring to FIG. 10. In the second embodiment, the first receiving rib 47A is provided on the upper surface with first slopes 52 that are inclined downward from a central top position of the upper surface to lateral opposite ends of the upper surface. Because the structure of the electrical junction box according to the second embodiment is substantially the same as the structure of the first embodiment, duplicated descriptions are omitted by giving the same reference numbers to the same features in the second embodiment.

According to the second embodiment, the water that has dropped onto the first receiving rib 47A may flow readily toward the first guide ribs 48A along the first slopes 52. Thus, it is possible to enhance a drainage function of the first receiving rib 47A.

Figure 11:
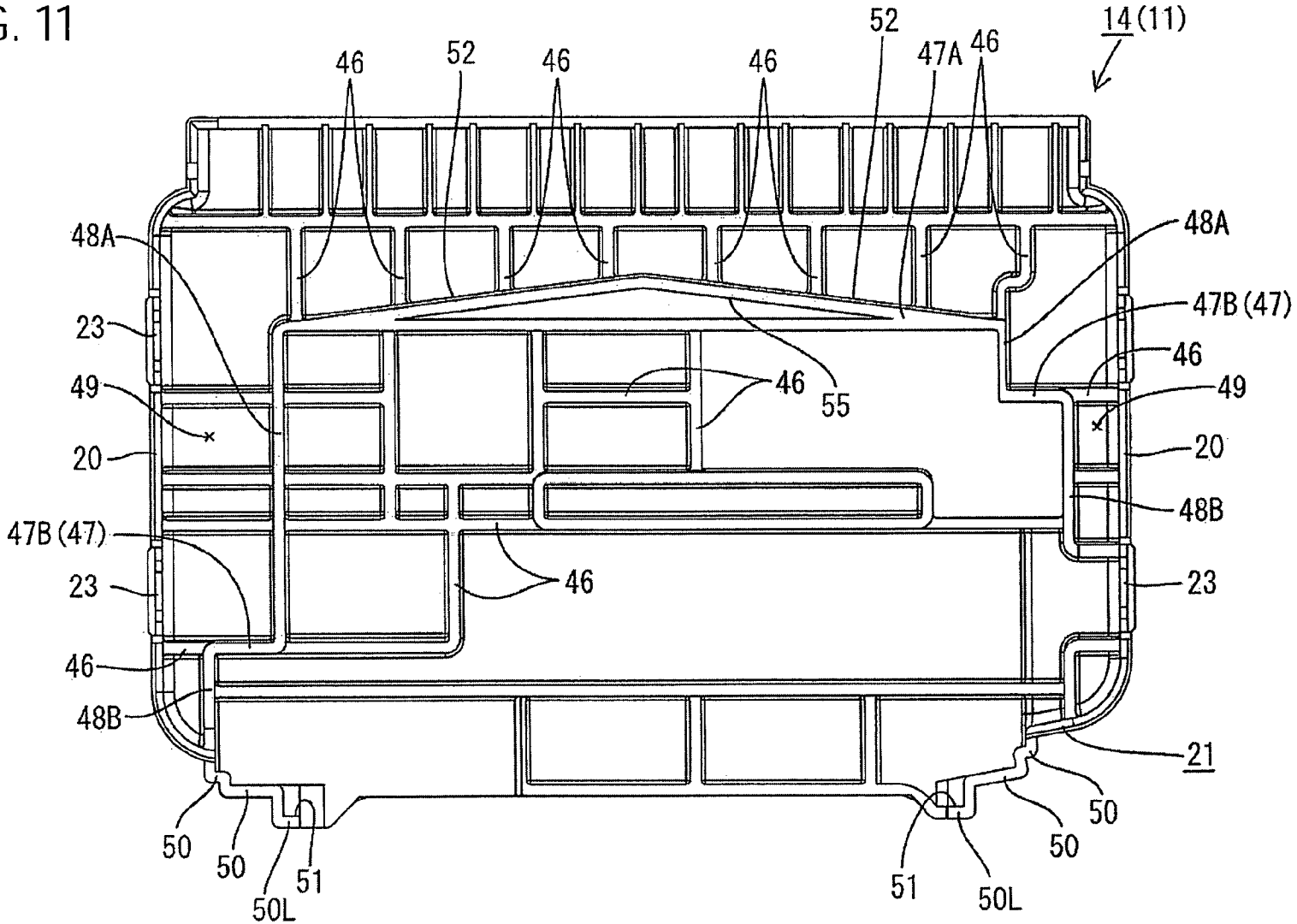
FIG. 11 is a back side view of a cover in a third embodiment of the electrical junction box, illustrating a rear side of the cover.

Next, a third embodiment of the electrical junction box 10 in accordance with the exemplary embodiment will be described by referring to FIG. 11. In the third embodiment, the first receiving rib 47A is provided with a lightening portion 55 for reducing a weight. Because the structure of the electrical junction box according to the third embodiment is substantially the same as the structure of the second embodiment, duplicated descriptions are omitted by giving the same reference numbers to the same features in the third embodiment.

According to the third embodiment, because the first receiving rib 47A is provided with the lightening portion 55, it is possible to restrain the front wall 19 of the cover 14 from causing a deformation due to a shrinkage cavity or the like. Thus, it is possible to enhance stability in size of the cover 14.

Figure 12:
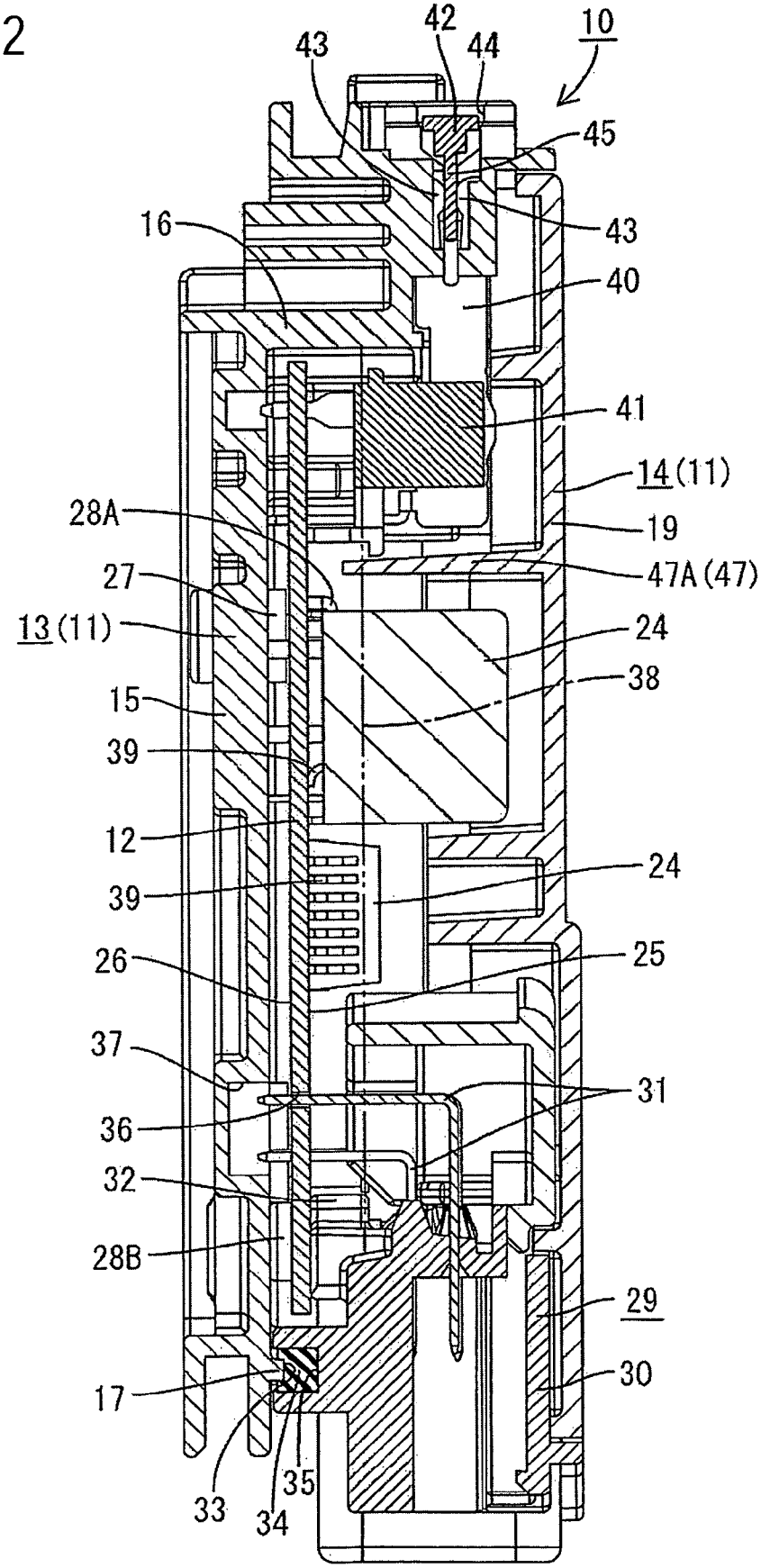
FIG. 12 is a side section view of a fourth embodiment of the electrical junction box in accordance with the exemplary embodiments.

Next, a fourth embodiment of the electrical junction box 10 in accordance with the exemplary embodiments will be described by referring to FIG. 12. In the fourth embodiment, a distal end edge of the first receiving rib 47A at the side of the circuit board 12 is embedded in the seal member 38. Because the structure of the electrical junction box according to the fourth embodiment is substantially the same as the structure of the first embodiment, duplicated descriptions are omitted by giving the same reference numbers to the same features in the fourth embodiment.

According to the fourth embodiment, it is possible to surely restrain the water that has dropped onto the first receiving rib 47A from flowing downward from the distal end edge at the side of the circuit board 12.

Figure 13:
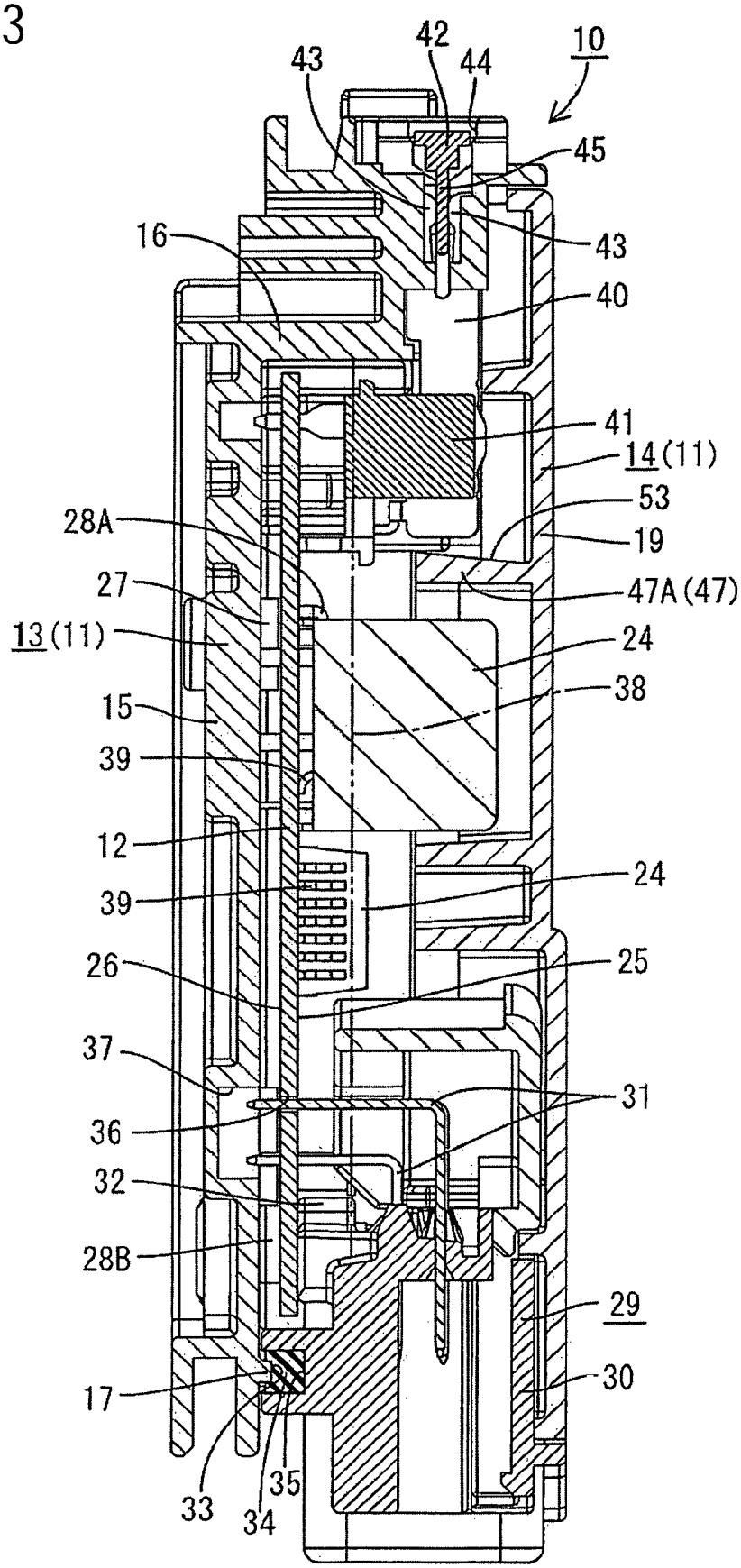
FIG. 13 is a side section view of a fifth embodiment of the electrical junction box in accordance with the exemplary embodiments.

Next, a fifth embodiment of the electrical junction box 10 in accordance with the exemplary embodiments will be described by referring to FIG. 13. In the fifth embodiment, the first receiving rib 47A is provided on the upper surface with a second slope 53 that is inclined downward from a distal end edge at the side of the circuit board 12 to the front wall 19. Because the structure of the electrical junction box according to fifth embodiment is substantially the same as the structure of the first embodiment, duplicated descriptions are omitted by giving the same reference numbers to the same features in the fifth embodiment.

According to the fifth embodiment, the water that has dropped onto the first receiving rib 47A flows toward the front wall 19 along the second slope 53. Thus, it is possible to restrain the water from flowing downward from the first receiving rib 47A to the side of the circuit board 12.

Figure 14:
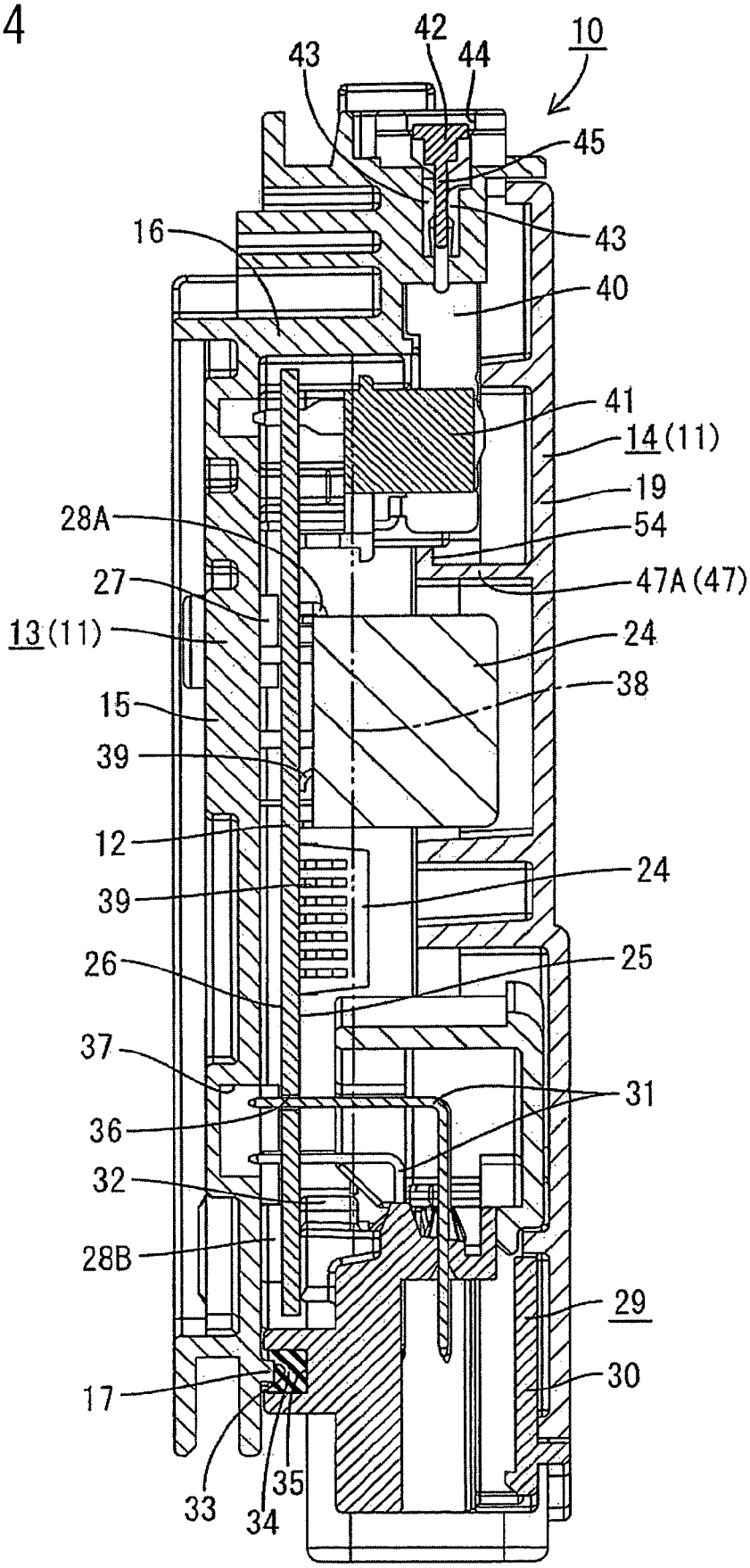
FIG. 14 is a side section view of a sixth embodiment of the electrical junction box in accordance with the exemplary embodiments.

Next, a sixth embodiment of the electrical junction box 10 in accordance with the exemplary embodiments will be described by referring to FIG. 14. In the sixth embodiment, the first receiving rib 47A is provided on a distal end edge at the side of the circuit board 12 with a cutoff wall 54. The cutoff wall 54 is formed over the whole lateral width of the first receiving rib 47A. Because the structure of the electrical junction box according to the sixth embodiment is substantially the same as the structure of the first embodiment, duplicated descriptions are omitted by giving the same reference numbers to the same features in the sixth embodiment.

According to the sixth embodiment, it is possible to surely restrain the water, which drops down onto the first receiving rib 47A, from flowing downward from the distal end edge at the side of the circuit board 12 and adhering to the circuit board 12.

It should be noted that the present invention is not limited to the embodiments described above and illustrated in the drawings. For example, the following embodiments will fall in the technical scope of the present invention.

(1) Although the front wall 19 opposed to the mounting surface 25 of the circuit board 12 is provided with the receiving ribs and guide ribs in the above embodiments, the present invention is not limited to these embodiments. The rear wall 15 opposed to the non-mounting surface 26 of the circuit board 12 may be provided with the receiving ribs and guide ribs. Also, both of the front wall 19 opposed to the mounting surface 25 of the circuit board 12 and the rear wall 15 opposed to the non-mounting surface 26 may be provided with the receiving ribs and guide ribs, for example.

(2) Although the circuit board 12 is disposed vertically in the casing 11 in the above embodiments, the present invention is not limited to these embodiments. The circuit board 12 may be disposed horizontally in the casing 11, for example.

(3) Although the seal member 38 is filled in the casing 11 to embed the circuit board 12 to the seal member 38 in the above embodiments, the present invention is not limited to these embodiments. For example, in the case where the circuit board 12 is provided on the non-mounting surface 26 with the receiving ribs and guide ribs, the seal member 38 may be omitted.

(4) Although the mating member may be the fuse in the above embodiments, the present invention is not limited to these embodiments. The mating member may be a connector connected to a wire harness, for example.

(5) Although the first and second slopes 52 and 53 of the receiving rib 47A are inclined downward from the central top position of the rib to the lateral opposite ends in the second and third embodiments, the present invention is not limited to these embodiments. The first slope 52 may be inclined downward from one end of the receiving rib 47A to the other end, for example.

What is claimed is:

1. An electrical junction box comprising:

a casing having a sidewall, a bottom wall defining drain holes, and an upper wall defining openings, the casing housing a circuit board on which electrically conductive paths are formed, and the openings being adapted to contain a mating member;

receiving ribs that project inward from an inside of the side wall of the casing at a position below the openings to receive water that enters the casing from the openings;

guide ribs that project inward from the inside of the side wall provided with the receiving ribs and extend from end edges of the receiving ribs to guide the water that is received on the receiving ribs to the bottom wall of the casing.

2. The electrical junction box according to claim 1, wherein the circuit board is housed in the casing so that the circuit board is disposed vertically, and the receiving ribs and guiding ribs are provided on a facing side wall of the casing opposed to at least one of surfaces of the circuit board.

3. The electrical junction box according to claim 2, wherein the one of surfaces of the circuit board defines a mounting surface on which electronic components are mounted, and the facing side wall is opposed to the mounting surface.

4. The electrical junction box according to claim 3, wherein an other surface of the circuit board defines a non-mounting surface, and a seal member is filled in a space between the non-mounting surface and the side wall of the casing opposed to the non-mounting surface.

5. The electrical junction box according to claim 4, wherein the mounting surface of the circuit board is covered with the seal member.

6. The electrical junction box according to claim 5, wherein the end edges of the receiving ribs at a side of the circuit board are embedded in the seal member.

7. The electrical junction box according to claim 1, wherein one of the receiving ribs is provided on the upper surface with first slopes that are inclined toward end edges provided with the guide ribs.

8. The electrical junction box according to claim 2, wherein one of the receiving ribs is provided on the upper surface with a second slope that is inclined from an end edge at a side of the circuit board to the facing side wall.

9. The electrical junction box according to claim 1, wherein one of the receiving ribs is provided on a side of the circuit board with a cutoff wall projecting upward.

10. An electrical junction box for housing a circuit board, the electrical junction box comprising:

a housing having a sidewall, a bottom wall defining drain-holes, and an upper wall with fuse-receiving sections; and a drainage passage defined by the sidewall of the housing, wherein the drainage passage transfers fluid entering the junction box via the fuse-receiving sections directly to the drain holes so that all the fluid, or nearly all the fluid, does not contact the circuit board.

11. The electrical junction box according to claim 10, the circuit board being disposed in the housing in a vertical direction, wherein the drainage passage is disposed between a first side of the circuit board and the sidewall of the housing.

12. The electrical junction box according to claim 11, further comprising a seal member disposed on a second sidewall of the circuit board opposite the first side wall of the circuit board.

* * * * *